US009528460B2

(12) United States Patent
Takahashi

(10) Patent No.: US 9,528,460 B2
(45) Date of Patent: Dec. 27, 2016

(54) FUEL INJECTION APPARATUS

(71) Applicant: Fuji Jukogyo Kabushiki Kaisha, Tokyo (JP)

(72) Inventor: Daisuke Takahashi, Tokyo (JP)

(73) Assignee: FUJI JUKOGYO KABUSHIKI KAISHA, Tokyo (JP)

( * ) Notice: Subject to any disclaimer, the term of this patent is extended or adjusted under 35 U.S.C. 154(b) by 56 days.

(21) Appl. No.: 14/599,060

(22) Filed: Jan. 16, 2015

(65) Prior Publication Data

US 2015/0219035 A1 Aug. 6, 2015

(30) Foreign Application Priority Data

Jan. 31, 2014 (JP) ..... 2014-16404

(51) Int. Cl.
*F02D 41/30* (2006.01)
*F02D 41/18* (2006.01)
(Continued)

(52) U.S. Cl.
CPC ..... *F02D 41/06* (2013.01); *F02D 41/064* (2013.01); *F02D 41/1495* (2013.01); *F02D 41/1475* (2013.01)

(58) Field of Classification Search
CPC .. F02D 41/00; F02D 41/0008; F02D 41/1441; F02D 41/1454; F02D 41/1456; F02D 41/1495; F02D 41/2454; F02D 41/22; F02D 41/30; F02D 41/18; F02D 41/182; Y02T 10/40; Y02T 10/44; Y02T 10/123
(Continued)

(56) References Cited

U.S. PATENT DOCUMENTS 6,026,794 A * 2/2000 Kadowaki ..... F02D 41/22 123/674
7,983,831 B2 * 7/2011 Tsunooka ..... F02D 19/0684 123/1 A (Continued)

FOREIGN PATENT DOCUMENTS

JP 2006-177288 A 7/2006
JP 2010-001846 A 1/2010
JP 2013-117203 A 6/2013

OTHER PUBLICATIONS

JPO Notification of Reasons for Refusal dated Nov. 20, 2015 and Decision of Grant dated Apr. 26, 2016.

*Primary Examiner* — John Kwon
*Assistant Examiner* — Johnny H Hoang
(74) *Attorney, Agent, or Firm* — McGinn IP Law Group, PPLC.

(57) ABSTRACT

A fuel injection apparatus includes an injector that injects fuel into a combustion chamber or an intake port of an internal combustion engine; an injection amount controller that controls a fuel injection amount of the injector and corrects the fuel injection amount to increase when the internal combustion engine is in a given cold state; an air-fuel ratio detector that detects an air-fuel ratio of the internal combustion engine; and an air-fuel ratio rich fault determiner that determines an air-fuel ratio rich fault when the air-fuel ratio exists on a rich side than a predetermined determination value. The air-fuel ratio rich fault determiner shifts the predetermined determination value toward the rich side in accordance with the increasing correction of the fuel injection amount so as to correct the predetermined determination value.

11 Claims, 3 Drawing Sheets

(51) Int. Cl.
*F02D 41/06* (2006.01)
*F02D 41/14* (2006.01)

(58) Field of Classification Search
USPC ..... 123/299, 300, 305, 443, 445, 453, 674,123/690, 700, 704; 701/102–105, 107, 114
See application file for complete search history.

(56) References Cited

U.S. PATENT DOCUMENTS

| | | | | |
|---|---|---|---|---|
| 8,225,647 | B2 * | 7/2012 | Mukai | F02D 19/0623 73/114.55 |
| 8,763,587 | B2 * | 7/2014 | Wakao | F02D 33/006 123/445 |
| 2004/0182378 | A1 * | 9/2004 | Oshimi | F02D 41/0025 123/685 |
| 2005/0216175 | A1 * | 9/2005 | Takahashi | F02D 41/1454 701/109 |
| 2008/0040018 | A1 * | 2/2008 | Katoch | F02D 13/0215 701/103 |
| 2010/0211290 | A1 * | 8/2010 | Kidokoro | F02D 41/1408 701/103 |
| 2011/0029218 | A1 * | 2/2011 | Nakagawa | F02D 41/0085 701/103 |
| 2011/0219861 | A1 * | 9/2011 | Kayama | F02D 41/22 73/114.72 |
| 2013/0325299 | A1 * | 12/2013 | Ujiie | F02D 41/30 701/104 |

* cited by examiner

FUEL INJECTION APPARATUS

CROSS-REFERENCE TO RELATED APPLICATIONS

The present application claims priority from Japanese Patent Application No. 2014-16404 filed on Jan. 31, 2014, the entire contents of which are hereby incorporated by reference.

BACKGROUND

1. Technical Field

The present invention relates to a fuel injection apparatus of an internal combustion engine which has a diagnostic function to detect an air-fuel ratio fault, and more particularly relates to the fuel injection apparatus which can suitably diagnose the air-fuel ratio fault, even if a fuel injection amount is corrected to increase.

2. Related Art

A fuel injection apparatus provided in, for example, a gasoline engine for a passenger car has a self-diagnostic function which compares a value (for example, an actually measured lambda λ) related to an air-fuel ratio detected by an air-fuel ratio sensor or the like provided in an exhaust pipe, with a given threshold value, and which determines a fault in which an air-fuel ratio is excessively rich or lean. Such a self-diagnostic function should be configured to prevent misdiagnosis, even if the properties of the supplied fuel varies due to variations of fuels distributed in the market.

For example, Japanese Unexamined Patent Application Publication (JP-A) No. 2010-1846 discloses that a diagnostic apparatus for an internal combustion engine that can utilize gasoline and alcohol mixed-fuel has a function which estimates the concentration of alcohol in the mixed-fuel and utilizes a stored value of the concentration of alcohol estimated during the former trip immediately after starting the engine.

Generally speaking, during a cold period and a cold temperature period, in which fuel is difficult to vaporize, in order to ensure fuel ignition and fuel stability even if fuel of relatively low volatility is supplied, a fuel injection amount is corrected to increase during a warm period (after warm-up) and thus the air-fuel ratio is likely to be rich. However, in the case where relatively volatile fuel is supplied and increasing correction is performed, the air-fuel ratio detected by an air-fuel ratio sensor or the like becomes excessively rich. As a result, erroneous determination, in which the air-fuel ratio is abnormally rich, may be established despite the fact that the fuel injection apparatus itself is normal.

Thus, heretofore, the diagnosis is not carried out during the cold period when the increase value correction of fuel is performed and misdiagnosis might occur. Accordingly, even if a fault occurs in the fuel injection apparatus, a relatively long period is required to detect the fault after starting the driving.

SUMMARY OF THE INVENTION

The present invention has been designed in consideration of the circumstances described above, and an object thereof is to provide a fuel injection apparatus which can suitably diagnose an air-fuel ratio fault, even if a fuel injection amount is corrected to increase.

An aspect of the invention provides a fuel injection apparatus including an injector that injects fuel into a combustion chamber or an intake port of an internal combustion engine; an injection amount controller that controls a fuel injection amount of the injector and corrects the fuel injection amount to increase when the internal combustion engine is in a given cold state; an air-fuel ratio detector that detects an air-fuel ratio in the internal combustion engine; and an air-fuel ratio rich fault determiner that determines an air-fuel ratio rich fault when the air-fuel ratio is on a rich side than a predetermined determination value. The air-fuel ratio rich fault determiner shifts the predetermined determination value toward the rich side in accordance with the increasing correction of the fuel injection amount so as to correct the predetermined determination value.

The fuel injection apparatus may further include an air-fuel ratio lean fault determiner which may determine an air-fuel ratio lean fault when the air-fuel ratio is on a lean side than a predetermined determination value. The air-fuel ratio lean fault determiner may shift the predetermined determination value toward the rich side in accordance with the increasing correction of the fuel injection amount so as to correct the predetermined determination value.

Another aspect of the invention provides a fuel injection apparatus including an injector that injects fuel into a combustion chamber or an intake port of an internal combustion engine; an injection amount controller that controls a fuel injection amount of the injector and corrects the fuel injection amount to increase when the internal combustion engine is in a given cold state; an air-fuel ratio detector that detects an air-fuel ratio in the internal combustion engine; and an air-fuel ratio lean fault determiner that determines an air-fuel ratio lean fault when the air-fuel ratio is on a lean side than a predetermined determination value. The air-fuel ratio lean fault determiner shifts the determination value toward the rich side in accordance with the increasing correction of the fuel injection amount so as to correct the predetermined determination value.

DETAILED DESCRIPTION

The invention achieves the object of providing a fuel injection apparatus that can suitably diagnose an abnormal fault pertaining to an air-fuel ratio, even if a fuel injection amount has been corrected to increase, by detecting an actual air-fuel ratio of an engine, comparing the actual air-fuel ratio with a threshold value, determining a rich fault and a lean fault of the air-fuel ratio, and correcting the threshold value so as to shift toward the rich side on the basis of the increasing correction amount of fuel.

Hereinafter, an example of the present invention will be described in detail with reference to the accompanying drawings.

Figure 1:
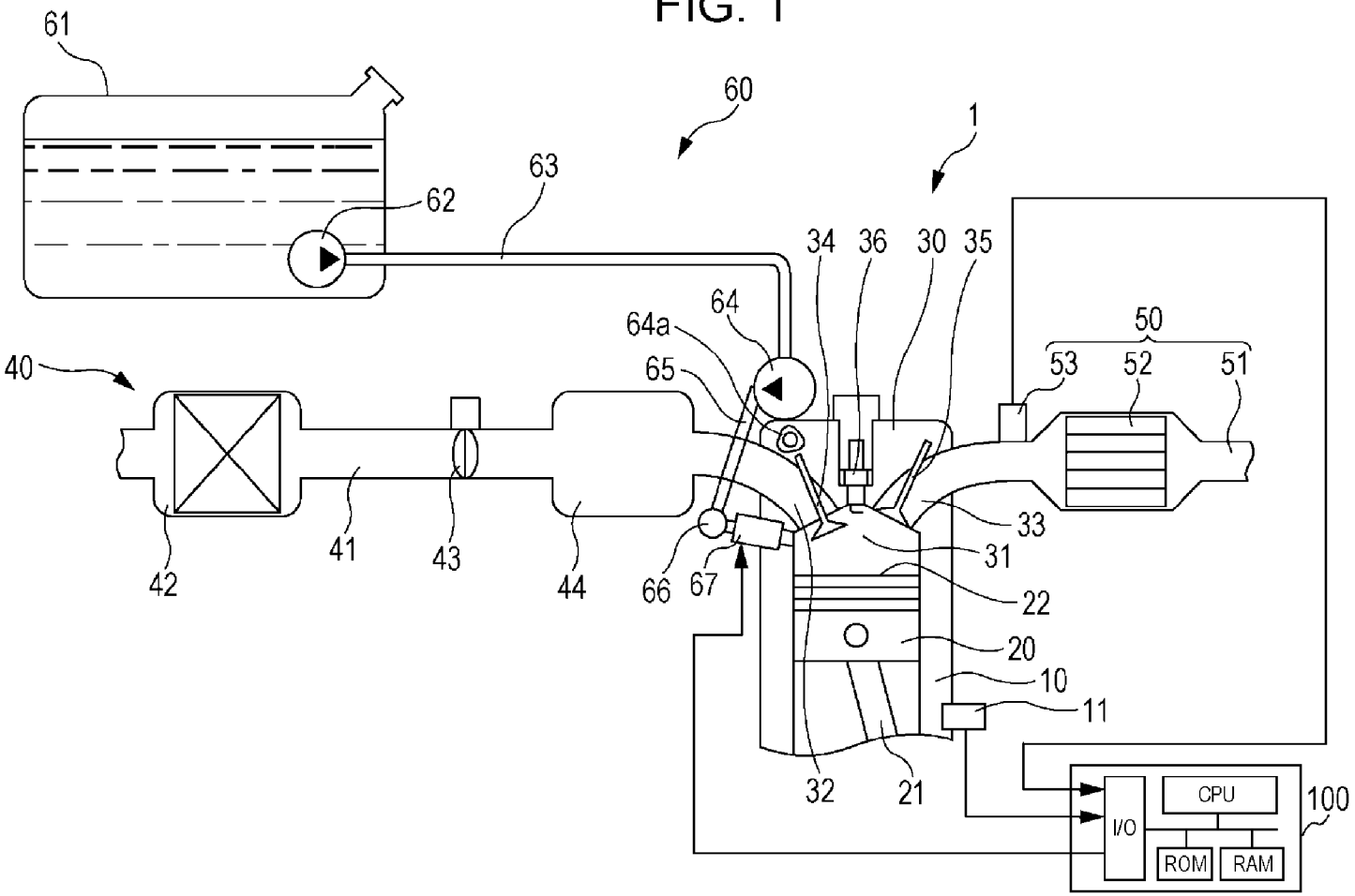
FIG. 1 is a schematic view of an engine provided with a fuel injection apparatus according to an example of the invention.

A fuel injection apparatus of the example is provided in, for example, a gasoline direct-injection engine installed in a vehicle such as a passenger car. FIG. 1 is a schematic view of an engine provided with the fuel injection apparatus according to the example. An engine 1 includes a cylinder 10, a piston 20, a cylinder head 30, an intake device 40, an exhaust device 50, a fuel supply device 60, an engine control unit 100, and the like.

The cylinder 10 has a sleeve into which the piston 20 is inserted. The cylinder 10 is formed in a cylinder block integrated with a crankcase (not shown). The crankcase rotatably supports and contains a crank shaft (not shown) that serves as an output shaft of the engine 1. The cylinder 10 is provided with the cylinder head 30 and a water temperature sensor 11 that detects a temperature of cooling water that flows in a water jacket provided on a periphery of the sleeve. An output from the water temperature sensor 11 is transmitted to the engine control unit 100.

The piston 20 is inserted into the sleeve of the cylinder 10 to reciprocate in the sleeve. The piston 20 is coupled via a connecting rod 21 to a crank shaft (not shown). A crown 22 of the piston 20 defines a combustion chamber of the engine 1 in cooperation with the cylinder head 30.

The cylinder head 30 is provided on an end of the cylinder 10 opposite to the crank shaft. The cylinder head 30 has a combustion chamber 31, an intake port 32, an exhaust port 33, an intake valve 34, an exhaust valve 35, a spark plug 36, and the like. The combustion chamber 31 is concaved to be opposed to the crown 22 of the piston 20. For example, the combustion chamber 31 is formed into a pent-roof shape. The shape of the combustion chamber 31 will be described later in detail.

The intake port 32 is a flow passage which introduces air for combustion (fresh air) into the combustion chamber 31. The exhaust port 33 is a flow passage which expels combusted gas (exhaust gas) from the combustion chamber 31. Each cylinder is provided with, for example, two units of the intake ports 32 and two units of the exhaust ports 33.

The intake valve 34 and the exhaust valve 35 open and close the intake port 32 and the exhaust port 33 respectively at given valve timing. Each of the intake valve 34 and the exhaust valve 35 is driven by a valve driving mechanism such as a cam shaft and a rocker arm.

The spark plug 36 generates a spark at the given ignition time in response to an ignition signal from the engine control unit 100 to ignite a fuel-air mixture. The spark plug 36 is disposed on a substantially centered part of the combustion chamber 31 (a position near a center line of the cylinder 10).

The intake device 40 induces combustion air into the engine 1. The intake device 40 has an intake duct 41, an air cleaner 42, a throttle 43, an intake manifold 44, and the like. The intake duct 41 is a tubular passage which takes in air from the atmosphere and supplies it to the engine 1. The air cleaner 42 is disposed near an inlet of the intake duct 41 and filters dusts in the air to purify the air. An air flow meter (not shown) is provided on an outlet of the air cleaner 42 to measure an air amount (an intake air amount into the engine 1) which flows in the intake duct 41. The throttle 43 is disposed on the downstream of the air cleaner 42 in the intake duct 41 so as to adjust an output of the engine 1 by reducing the intake air amount. The throttle 43 has a valve body such as a butterfly valve, an electric actuator which drives the valve body, a throttle sensor which detects an opening degree of the throttle, and the like. The electric actuator is driven in response to a control signal from the engine control unit 100. The intake manifold 44 is disposed downstream of the throttle 43 and has a container-shaped surge tank, a branch tube connected with the intake port 32 of each cylinder to induce fresh air into the port 32.

The exhaust device 50 expels exhaust gas from the engine 1. The exhaust device 50 has an exhaust pipe 51, a catalytic converter 52, an air-fuel ratio (A/F) sensor 53, and the like. The exhaust pipe 51 is a tubular passage which expels exhaust gas from the exhaust port 33. The catalytic converter 52 is provided on an intermediate part of the exhaust pipe 51. The catalytic converter 52 is structured by carrying precious metal such as platinum and rhodium on an aluminum carrier having a honeycomb configuration and is provided with a three way catalyst that purifies such as HC, NOx, and CO. The air-fuel ratio (A/F) sensor 53 is a linear output type lambda sensor which detects a current air-fuel ratio of the engine 1 on the basis of a property of the exhaust gas. The air-fuel ratio sensor 53 is disposed on the upstream of the catalytic converter 52 on the exhaust pipe 51.

The fuel supply device 60 has a fuel tank 61, a feed pump 62, a fuel transfer pipe 63, a high pressure pump 64, a fuel pipe 65, a delivery pipe 66, an injector 67, and the like.

The fuel tank 61 is a container which stores fuel (gasoline). The fuel tank 61 is mounted, for example, under a floor of a rear section of a vehicle body. The feed pump (a low pressure pump) 62 pressure-feeds fuel in the fuel tank 61 via the fuel transfer pipe 63 to the high pressure pump 64. The high pressure pump 64 highly pressurizes the fuel fed from the feed pump 62 and supplies the pressurized fuel via the fuel pipe 65 to the delivery pipe 66 which also serves as an accumulator. The high pressure pump 64 is driven by a cam shaft **64*a* which is provided on the cylinder head 30 and drives the intake valve 34**.

The injector 67 has a needle valve which is driven by an actuator having, for example, a solenoid or a piezo element. The injector 67 injects the high pressure fuel pressurized in the delivery pipe 66 at a given time by a given injection amount in response to an injection signal generated in the engine control unit 100. The injector 67 injects the fuel by a plurality of times per cycle. As illustrated in FIG. 1, a nozzle of the injector 67 is inserted into the cylinder from the side of the intake valve 34 on the side of the combustion chamber 31 (the cylinder bore side).

The engine control unit 100 generally controls the engine 1 and its auxiliary devices. The engine control unit 100 serves as the injection amount controller and the air-fuel ratio rich fault determiner of the present invention in this example. The engine control unit 100 has an information processing device such as a CPU, a storage device such as a RAM or a ROM, an input and output interface, a bus which connects them to one another, and the like.

The engine control unit 100 sets a fuel injection amount and fuel injection timing of the injector 67 of each cylinder on the basis of an air intake amount of the engine 1 detected by an air flow meter, a degree of opening of the throttle valve detected by a throttle sensor, a revolution speed of the crankshaft detected by a crank angle sensor (not shown), and the like. Then, the engine control unit 100 applies an injection signal (a valve-opening signal) to the injector 67.

After a warm-up operation is completed and the temperature of cooling water detected by the water temperature sensor 11 becomes higher than a given value, the engine control unit 100 sets the fuel injection amount so that the air-fuel ratio (an actual value of lambda $\lambda$) detected by the air-fuel ratio sensor 53 and the like is substantially close a theoretical (stoichiometric) air-fuel ratio. In the case where the water temperature detected by the water temperature sensor 11 is equal to or lower than a given value, the engine control unit 100 performs increasing correction so that the fuel injection amount increases after warm-up.

The increasing correction is set so that ignition and combustion actions do not become unstable even in the case where commercially available fuel of low volatility is supplied, and so the increasing correction amount increases as the temperature of cooling water decreases.

The engine control unit 100 has a self-diagnostic (onboard diagnostic) function which compares a diagnostic value (a value which indicates the actual value of lambda λ in the current engine) calculated on the basis of the air-fuel ratio detected by the air-fuel ratio sensor 53 or the like with a rich-side determination value (a predetermined threshold value), and which determines an air-fuel ratio rich fault in the fuel injection apparatus in the case where the diagnostic value is on a rich side than a rich side determination value (hereinafter referred to "a determination value").

Suppose the determination value during increasing correction of the fuel injection amount is constantly same as the determination value for a non-correction state. Then, if increasing correction is performed, and relatively volatile fuel is supplied, the air-fuel ratio rich fault may be erroneously determined despite the fact that no fault occurs.

Thus, the engine control unit 100 in the present example of the invention corrects the determination value as described below.

Figure 2:
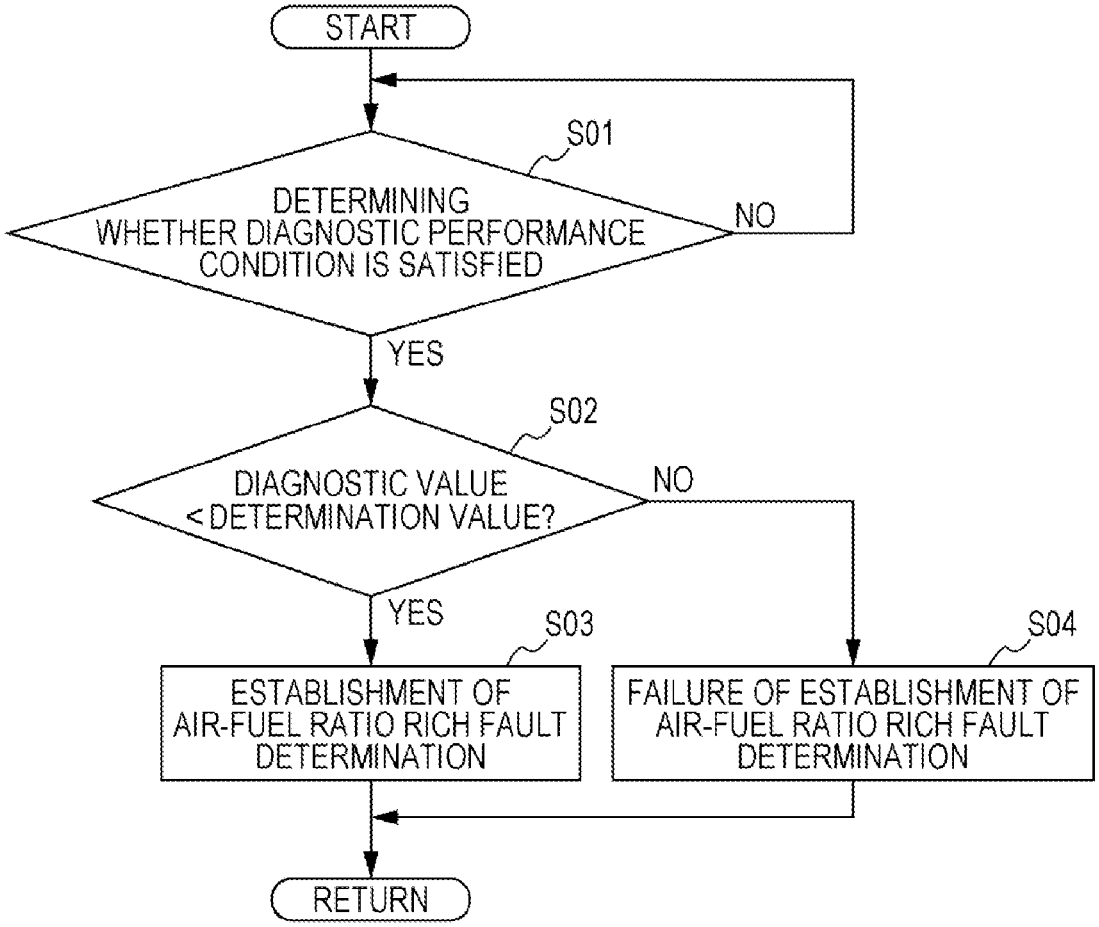
FIG. 2 is a flow chart which illustrates an operation of an air-fuel ratio rich fault diagnosis in the fuel injection apparatus according to according to the example.

FIG. 2 is a flow chart which illustrates an operation of an air-fuel ratio rich fault diagnosis. Each step of the operation will be described in order.

<Step S01: Determining Whether Diagnostic Performance Condition is Satisfied>

The engine control unit 100 determines whether a diagnostic performance condition is satisfied for diagnosis of the air-fuel ratio rich fault. If a feedback control of the air-fuel ratio (a closed loop control) starts after starting the engine 1, the engine control unit 100 determines that the diagnostic performance condition is satisfied, and the engine control unit 100 advances to step S02. On the other hand, if the feedback control of the air-fuel ratio does not start, the engine control unit 100 determines that the diagnostic performance condition is not satisfied, and step S01 is repeated.

<Step S02: Comparing Diagnostic Value with Determination Value>

The engine control unit 100 compares the diagnostic value, which correlates the current value of lambda λ of the current engine 1, with the determination value (the predetermined threshold value). The diagnostic value is calculated by dividing an actual air-fuel ratio (A/F) by the stoichiometric air-fuel ratio of the fuel. The actual air-fuel ratio (A/F) is obtained by adding a given learning value to a feedback amount that is an air-fuel ratio calculated on the basis of the output from the air-fuel ratio sensor 53. The diagnostic value is equal to about 1 during stoichiometric combustion. The diagnostic value decreases when the fuel amount increases so that the fuel injection amount is corrected and increased to the rich side.

The determination value is set to be, for example, about 0.7 during a warm period in which increasing correction of the fuel injection amount is not performed. If the diagnostic value is smaller than the determination value (the diagnostic value is on the rich side), the engine control unit 100 advances to step S03. In the other cases, the engine control unit 100 advances to step S04.

If the engine 1 is operating in a cold period (the temperature of cooling water is low) and the increasing correction amount is added to the fuel injection amount, the determination value is corrected to decrease in accordance with the increasing correction amount (so that the determination value shifts on the rich side).

Figure 3:
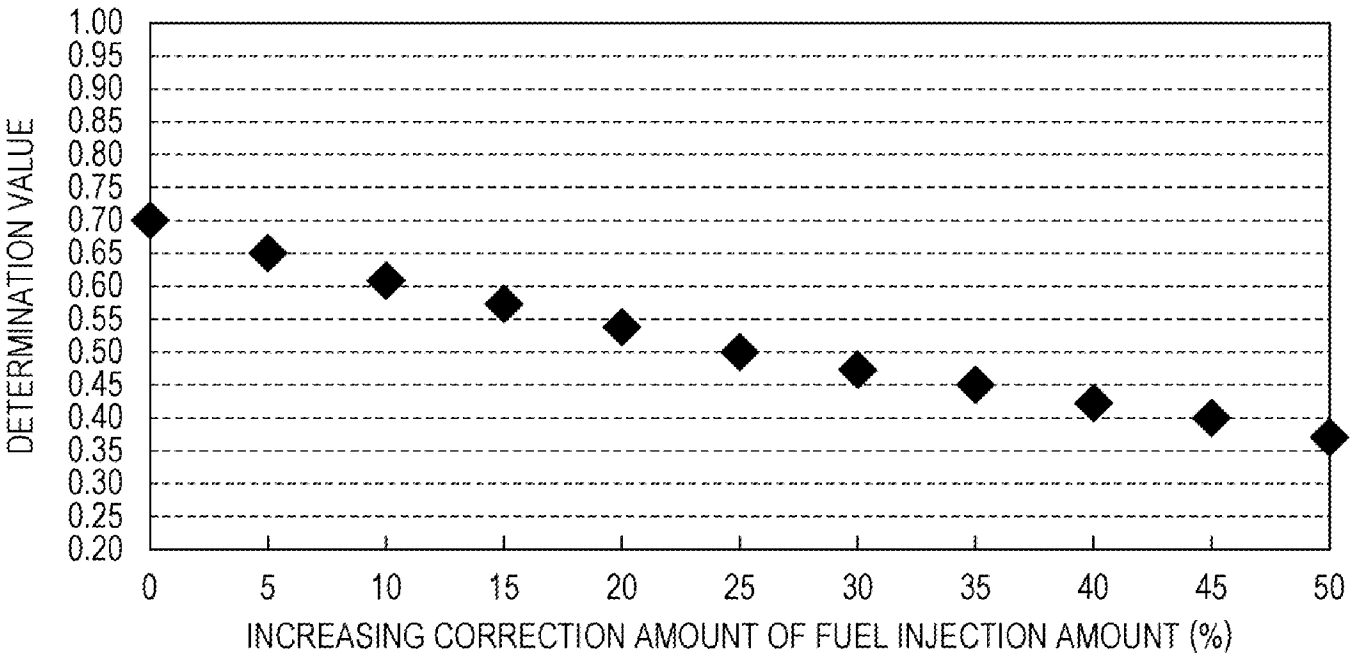
FIG. 3 is a graph which illustrates correction of a determination value on the basis of an increasing correction amount of a fuel injection amount in the fuel injection apparatus according to the example.

FIG. 3 is a graph which illustrates a correction of a determination value in accordance with the increasing correction amount of the fuel injection amount in the fuel injection apparatus according to the present example. In FIG. 3, the horizontal axis indicates the increasing correction amount (%) of the fuel injection amount while the vertical axis indicates the determination value. As illustrated in FIG. 3, the determination value is corrected to decrease substantially in line with the increase of the increasing correction amount.

<Step S03: Determination of Air-Fuel Ratio Rich Fault>

The engine control unit 100 determines the air-fuel ratio rich fault, sets a given fault flag, and completes (returns to) a series of the processes.

<Step S04: Non-Determination of Air-Fuel Ratio Rich Fault>

The engine control unit 100 does not determine the air-fuel ratio rich fault and completes (returns to) a series of processes.

According to the above-described example, the determination value of the air-fuel ratio rich fault is corrected to shift toward the rich side in accordance with the increasing correction amount of the fuel injection amount, whereby it is possible to prevent the air-fuel ratio rich fault from being erroneously determined despite the fact that no fault occurs, even if relatively volatile fuel is supplied to the engine during the increasing correction.

Suppose the determination value is set to be a constant value of, for example, 0.65. If the fuel injection amount is increased by 30% for the stoichiometric air-fuel ratio, the determination value becomes about 0.7 even though the system is in a normal state. Accordingly, slight variation in the determination value causes the air-fuel ratio rich fault to be erroneously determined. Also, if the fuel injection amount is increased by 35% or more, the diagnostic value becomes equal to or smaller than 0.65, even though the system is in a normal state. Accordingly, the air-fuel ratio rich fault is erroneously determined. Therefore, it is impossible to perform diagnosis correctly. Accordingly, it is necessary to stop diagnosis until the increasing correction is completed after warm-up is completed, or until the increasing correction amount becomes sufficiently small. If any fault should occur, it will require a long time to detect the fault.

According to the described example, such problems are overcome, and it is possible to precisely determine the air-fuel ratio rich fault with the start of the air-fuel ratio feedback control, even during the cold period.

(Alterations)

It should be noted that the invention is not limited to the example described above. Various changes and alterations can be made and fall within the technical scope of the invention.

(1) While the air-fuel ratio rich fault is described in the example, the invention can also be applied to air-fuel ratio lean fault diagnosis that determines an air-fuel ratio lean fault if the air-fuel ratio is on a lean side than a predetermined threshold value (a determination value). In this case, the determination value is also corrected to shift toward a rich side in accordance with the increasing correction amount of the fuel injection amount. In the related art techniques, the air-fuel ratio lean fault is often unlikely to be determined due to significant deviation between a target air-fuel ratio and the determination value in the increasing correction state of the fuel. This alteration can prevent such misdiagnosis in which the air-fuel ratio is determined to be normal despite the fact that a lean fault has occurred.

(2) Another value may be used as the diagnostic value as far as the diagnostic value indicates the air-fuel ratio of the engine. For example, diagnosis may be performed on the basis of an output value from the air-fuel ratio sensor. Alternatively, diagnosis may be performed on the basis of a learning correction value of the air-fuel ratio feedback control.

(3) The structure of the engine may be suitably altered. For example, the above example employs a cylinder injection (direct injection) engine in which fuel is directly injected into a cylinder. Alternatively, the invention can be applied to a port injection engine or a combination of the port injection engine and the cylinder injection engine.

Also, fuel is not limited to gasoline. The invention can be applied to an engine that uses another type of fuel as far as the engine is a premix spark ignition engine that sprays, vaporizes and then ignites liquid fuel.

(4) In the above example, the determination value is linearly corrected to the rich side, in accordance with the increasing correction of the fuel injection amount. Alternatively, for example, the determination value may be corrected so that the air-fuel ratio becomes rich in stages in accordance with, for example, an increase of the increasing correction amount.

The invention claimed is:

1. A fuel injection apparatus, comprising:

an injector that injects fuel into a combustion chamber or an intake port of an internal combustion engine;

an injection amount controller that controls a fuel injection amount of the injector and corrects the fuel injection amount to increase when the internal combustion engine is in a given cold state;

an air-fuel ratio detector that detects an air-fuel ratio in the internal combustion engine;

a water temperature sensor that detects a temperature of cooling water that flows in a water jacket provided on a periphery of the combustion chamber; and an air-fuel ratio rich fault determiner that determines an air-fuel ratio rich fault when the air-fuel ratio is on a rich side of a predetermined determination value, wherein the air-fuel ratio rich fault determiner shifts the predetermined determination value toward the rich side in accordance with an increasing correction of the fuel injection amount so as to correct the predetermined determination value such that when the internal combustion engine is in the given cold state based on the temperature of the cooling water, and the increasing correction of the fuel injection amount is added to the fuel injection amount, the predetermined determination value is corrected to decrease in accordance with the increasing correction of the fuel injection amount such that the predetermined determination value shifts on the rich side.

2. The fuel injection apparatus according to claim 1, further comprising:

an air-fuel ratio lean fault determiner which determines an air-fuel ratio lean fault when the air-fuel ratio is on a lean side of a predetermined determination value, wherein the air-fuel ratio lean fault determiner shifts the predetermined determination value toward the rich side in accordance with the increasing correction of the fuel injection amount so as to correct the predetermined determination value.

3. The fuel injection apparatus according to claim 1, wherein the injector injects fuel into the combustion chamber.

4. The fuel injection apparatus according to claim 1, wherein the air-fuel ratio detector comprises a linear output type lambda sensor which detects a current air-fuel ratio of the engine on a basis of a property of an exhaust gas from the combustion chamber.

5. The fuel injection apparatus according to claim 1, wherein, after a warm-up operation is completed and the temperature of cooling water detected by the water temperature sensor becomes higher than a given value, the injection amount controller sets the fuel injection amount such that the air-fuel ratio detected by the air-fuel ratio detector approaches a stoichiometric air-fuel ratio.

6. The fuel injection apparatus according to claim 5, wherein, when the temperature of cooling water detected by the water temperature sensor is equal to or lower than the given value, the injection amount controller performs the increasing correction such that the fuel injection amount increases after the warm-up operation.

7. A fuel injection apparatus, comprising:

an injector that injects fuel into a combustion chamber or an intake port of an internal combustion engine;

an injection amount controller that controls a fuel injection amount of the injector and corrects the fuel injection amount to increase when the internal combustion engine is in a given cold state;

an air-fuel ratio detector that detects an air-fuel ratio in the internal combustion engine;

a water temperature sensor that detects a temperature of cooling water that flows in a water jacket provided on a periphery of the combustion chamber; and an air-fuel ratio lean fault determiner that determines an air-fuel ratio lean fault when the air-fuel ratio exists on a lean side of a predetermined determination value, wherein the air-fuel ratio lean fault determiner shifts the predetermined determination value toward the rich side in accordance with an increasing correction of the fuel injection amount so as to correct the predetermined determination value such that when the internal combustion engine is in the given cold state based on the temperature of the cooling water, and the increasing correction of the fuel injection amount is added to the fuel injection amount, the predetermined determination value is corrected in accordance with the increasing correction of the fuel injection amount such that the predetermined determination value shifts on the rich side.

8. The fuel injection apparatus according to claim 7, wherein the injector injects fuel into the combustion chamber.

9. The fuel injection apparatus according to claim 7, wherein the air-fuel ratio detector comprises a linear output type lambda sensor which detects a current air-fuel ratio of the engine on a basis of a property of an exhaust gas from the combustion chamber.

10. The fuel injection apparatus according to claim 7, wherein, after a warm-up operation is completed and the temperature of cooling water detected by the water temperature sensor becomes higher than a given value, the injection amount controller sets the fuel injection amount such that the air-fuel ratio detected by the air-fuel ratio detector approaches a stoichiometric air-fuel ratio.

11. The fuel injection apparatus according to claim 10, wherein, when the temperature of cooling water detected by the water temperature sensor is equal to or lower than the given value, the injection amount controller performs the increasing correction such that the fuel injection amount increases after the warm-up operation.

* * * * *